United States Patent [19]

Troyer

[11] Patent Number: 4,821,342

[45] Date of Patent: Apr. 18, 1989

[54] UNDERGARMENT

[76] Inventor: Jane D. Troyer, 23811 Wilmarth, Farmington, Mich. 48024

[21] Appl. No.: 132,583

[22] Filed: Dec. 14, 1987

[51] Int. Cl.[4] ..... A41B 9/00

[52] U.S. Cl. ..... 2/82; 2/78 R; 2/73; 2/400; 2/406

[58] Field of Search ..... 2/211, 73, 406, 400, 2/78 R, 82; 604/385.1, 385.2

[56] References Cited

U.S. PATENT DOCUMENTS

| | | | |
|---|---|---|---|
| 1,475,018 | 11/1923 | Lassen | 2/211 X |
| 2,253,339 | 8/1941 | Livermore | 2/211 |
| 2,661,471 | 12/1953 | Neumayer | 2/211 X |
| 2,772,419 | 12/1956 | Silverstein | 2/406 |
| 3,324,480 | 6/1967 | Williams | 2/211 |
| 3,449,762 | 6/1979 | Dozier | 2/73 |
| 4,031,568 | 6/1977 | Huff | 2/406 |
| 4,490,148 | 12/1984 | Beckeström | 604/385 R |

*Primary Examiner*—Werner H. Schroeder
*Assistant Examiner*—Jeanette E. Chapman
*Attorney, Agent, or Firm*—Krass & Young

[57] ABSTRACT

An undergarment for incontinent persons typically constructed of front and rear panels. The front panel and the outer layer of the rear panel are preferably smooth nylon tricot and the inside surface of the rear nylon tricot panel has a breathable water-proofing material applied thereto. The preferred waterproofing material is a microporous polytetrafluouroethylene such as Gore-Tex®. In addition, the rear panel has an inside fabric layer of absorbent material such as cotton.

10 Claims, 1 Drawing Sheet

UNDERGARMENT

INTRODUCTION

This invention relates to garments and more particularly to the construction of an undergarment or the like which is intended to be worn by incontinent persons.

BACKGROUND OF THE INVENTION

Garments such as shorts, half slips, full slips and bed clothes have been designed for incontinent persons to exhibit certain waterproof and stain-resistant qualities. For example, it is known to construct an undergarment intended to be worn principally on the lower body and known as a "half slip" wherein the rear panel of the garment lined on the inside with a vinyl or rubber panel. Although initially effective for its intended purpose, a garment so constructed is excessively warm to the wearer and, at least in the case of the rubber lining, deteriorates rapidly with repeated machine washings.

SUMMARY OF THE INVENTION

It is the principal objective of the present invention to provide a garment such as a half slip intended for use by incontinent persons and which is both comfortable to wear in all temperature conditions and which is durable enough to retain its integrity throughout repeated machine washings.

In general, the objective of the invention is realized in the construction of a garment made up of front and rear panels, the rear panel being formed as a laminate of inside and outside fabric layers. The outside fabric layer of the rear panel and the entirety of the front panel are preferably formed of a smooth, essentially non-absorbent woven material such as nylon tricot. The inside layer of the rear panel is preferably formed of a highly absorbent natural material such as cotton. The inside and outside layers of the rear panel are appropriately united to form a single panel and the inside surface of the outer layer is treated with a polymeric waterproofing technique such as "Gore-Tex®" to prevent the transfer of fluids from the absorbent layer through the outside layer while retaining the important quality of "breathability"; i.e., the waterproofing material resists the passage of liquid but permits the passage of air.

It is to be understood that the terms "front" and "rear" are arbitrarily selected and used throughout this specification; i.e., whereas the garment hereinafter disclosed as an illustrative embodiment is an undergarment intended for use by females, and the rear panel of the garment is placed over the rearward part of the female body, other types of garments such as pajamas, nightgowns, hospital gowns and shorts intended for use by male wearers could be constructed in accordance with the invention. Depending on the garment, the laminated panel may be worn over the forward part of the body.

DETAILED DESCRIPTION OF THE ILLUSTRATIVE EMBODIMENT

Figure 1:
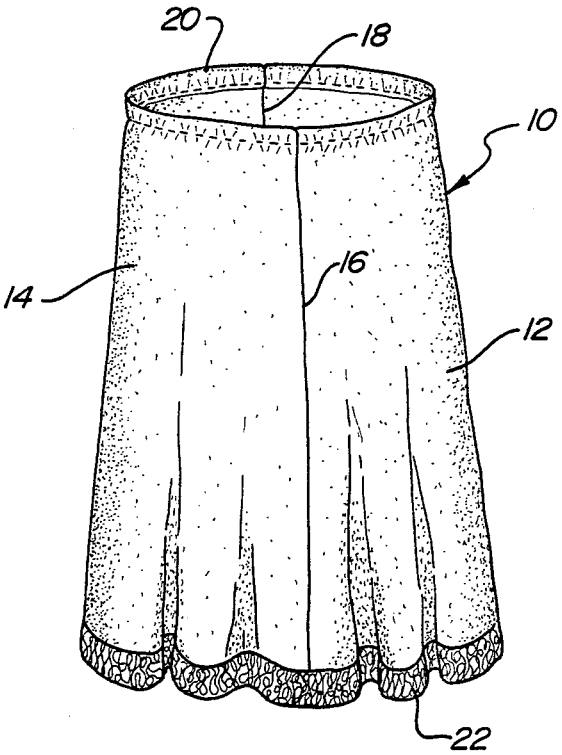
FIG. 1 is a perspective view of a half slip embodying the invention.
Figure 2:
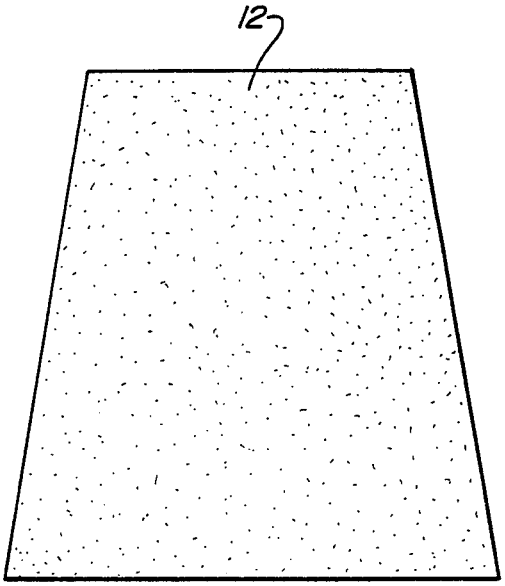
FIG. 2 is a plan view of the front panel of the half slip of FIG. 1.
Figure 3:
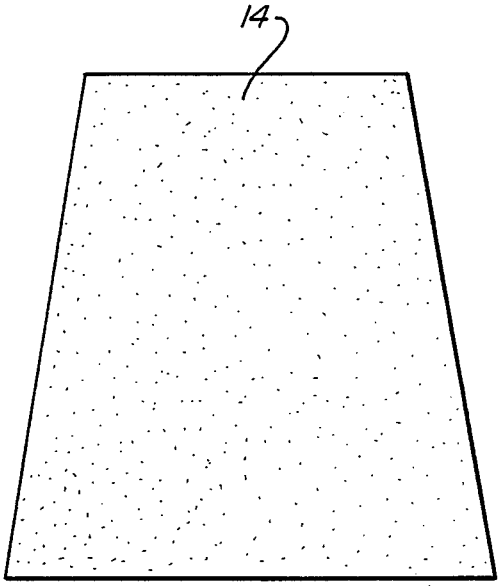
FIG. 3 is a plan view of the rear panel of the half slip of FIG. 1.

FIG. 1 illustrates an undergarment 10 in the form of a half slip intended to be worn over the lower part of the body by a female human. The undergarment 10 comprises a front panel of a smooth, essentially non-absorbent material such as nylon or rayon tricot and is cut in a generally trapezoidal pattern as shown by the plan view of FIG. 2. The undergarment 10 further comprises a rear panel 14 which is also cut in an essentially trapezoidal pattern as shown in FIG. 3 and which is constructed as a laminate hereinafter described. Front panel 12 and rear panel 14 are sewn together along seams 16 and 18 to form an essentially circumferentially continuous garment. The upper opening of the undergarment 10 is adapted to be worn around the waist and is hemmed as indicated at 20 around an interior band of elastic for comfortable fit. The bottom edge of the undergarment 12 is also hemmed and may be trimmed with a lace band 22 or the like.

As indicated above, the front panel 12 is a single ply or layer of smooth, non-absorbent material such as nylon tricot which is commonly used in the manufacture of female undergarments because of its durability, washability and smooth underlying qualities. In addition, nylon tricot has the further advantageous characteristic of "silkiness"; i.e., it slides smoothly under outer garments of wool and cotton.

Figure 4:
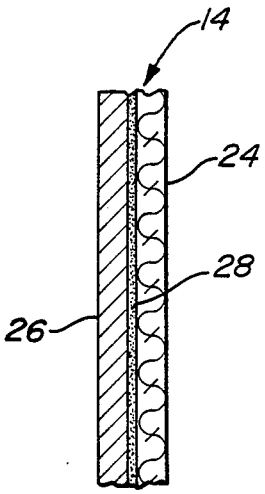
FIG. 4 is a sectional view showing the fabric of the laminated rear panel of the half slip of FIG. 1.

The rear panel 14, as best shown in FIG. 4, is formed as a laminate a waterproofing layer 28 of non-absorbent but air-permeable material such as Gore-Tex® which is essentially applied to the inside surface of the outer layer 24. In the preferred construction, the outer fabric layer 24 is nylon tricot so as to have the outward appearance and physical characteristics of the front panel 12. The inner layer 26 is preferably formed of a natural material such as cotton so as to be highly absorbent. The waterproofing material 28 may be applied only to the inside surface of the outside layer 24 and the laminate thereafter joined by means of stitching along the seams 16 and 18 and at the upper and lower ends 20 and 22, respectively. However, the preferred construction is to utilize the waterproofing layer 28 to essentially bond, fuse or unite the layers 24 and 26 to one another over the entire surface area of the rear panel 14 whereby the inside and outside layers cannot move relative to one another during normal physical movements of the wearer and will not separate from one another as a result of washing or wear.

As will be apparent to those familiar with fabrics, nylon tricot is an essentially non-absorbent material which is flat and warp-knitted out of synthetically manufactured nylon fibers. Rayon or the more expensive silk fibers may also be used to provide essentially the same physical characteristics. A fabric weight of 1.7 ounces for the tricot panels has been found satisfactory.

In use, the undergarment 10 is worn next to the body as a foundation layer and the outer layer such as a skirt or suit is worn thereover. Although, the invention has been described with reference to a half slip, it will be apparent to those reading this specification that the invention may also be embodied in a full slip or in shorts or trouser-like garments which, when worn by males, may be best constructed to have the waterproofing layer at the front. Finally, another alternative is to construct the garment such that both the front and rear are waterproofed in accordance with the specification given herein.

The term "Gore-Tex ®," as used herein, is intended to denote a preferred and commercially available fabric which has been treated on one side with polytetraflouroethylene so as to be microporous as disclosed in U.S. Pat. Nos. 4,482,516 and 4,557,957 owned by W. L. Gore and Associates, Inc. of Newark, Del. Other equivalent materials may also be employed.

I claim:

1. A garment intended to be worn principally on the lower body comprising:

a front panel;

a rear panel; and means joining said front and rear panels to form an undergarment which is essentially circumferentially continuous;

the front panel being formed at least in part of a smooth, essentially non-absorbent fabric, and the rear panel being formed as a laminate of outside and inside fabric layers, the outside layer being formed of a smooth essentially non-absorbent fabric and having an organic waterproofing material applied to an inside surface thereof, the inside layer being formed of an absorbent fabric.

2. An undergarment as defined in claim 1 wherein the front panel and the outside layer of the rear panel are a tricot weave of a synthetic fabric.

3. An undergarment as defined in claim 2 wherein the synthetic fabric is nylon.

4. An undergarment as defined in claim 1 wherein the inside layer is a natural material such as cotton.

5. An undergarment as defined in claim 1 wherein the waterproofing material essentially joins the inside and outside layers to one another over at least a substantial portion of the area of said rear panel.

6. An undergarment as defined in claim 5 wherein the front panel and the outside layer of the rear panel are a tricot weave of a synthetic material such as nylon.

7. An undergarment as defined in claim 5 wherein the inside layer is formed of a natural material such as cotton.

8. The undergarment as defined in claim 1 wherein the front and rear panels are essentially trapezoidal and the undergarment is a half slip.

9. The undergarment as defined in claim 1 wherein the waterproofing material is a microporous polytetraflouroethylene.

10. An undergarment for the lower body comprising at least one panel formed as a laminate of outside and inside fabric layers, the outside fabric layer being formed of a smooth, essentially non-absorbent fabric and having an organic waterproofing material applied to the inside surface thereof, the inside layer being formed of an absorbent fabric which is to be worn next to the body.

* * * * *